US005425323A

United States Patent [19]

Amundsen

[11] Patent Number: 5,425,323

[45] Date of Patent: Jun. 20, 1995

[54] EQUIPMENT FOR RECOVERY OF LIQUID TANK CARGO FROM A VESSEL

[76] Inventor: Viggo Amundsen, Rute 15, N-1450 Nesoddtangen, Norway

[21] Appl. No.: 938,123

[22] PCT Filed: Feb. 18, 1991

[86] PCT No.: PCT/NO91/00022

§ 371 Date: Apr. 1, 1993

§ 102(e) Date: Apr. 1, 1993

[87] PCT Pub. No.: WO91/12169

PCT Pub. Date: Aug. 22, 1991

[30] Foreign Application Priority Data

Feb. 19, 1990 [NO] Norway ..... 900773
Jun. 14, 1990 [NO] Norway ..... 902656

[51] Int. Cl.[6] ..... B63B 25/08
[52] U.S. Cl. ..... 114/74 R
[58] Field of Search ..... 114/74 R, 74 T, 256; 405/68; 220/666

[56] References Cited

U.S. PATENT DOCUMENTS 3,132,357 5/1964 Fenster .
3,724,662 4/1973 Ortiz .
3,735,721 5/1973 Leguijt ..... 114/74 T
4,373,462 2/1983 Fish .
4,399,765 8/1983 Alkner et al. .
4,960,347 10/1990 Strange ..... 114/256
5,052,319 10/1991 Beyrouty ..... 114/256

FOREIGN PATENT DOCUMENTS 43821 1/1971 Finland .
47590 3/1973 Finland .
1110542 1/1959 Germany ..... 114/74 T
2413830 2/1975 Germany .
432397 12/1980 Sweden .
423559 3/1982 Sweden .
460710 9/1989 Sweden .

*Primary Examiner*—Jesus D. Sotelo
*Attorney, Agent, or Firm*—Bacon & Thomas

[57] ABSTRACT

Equipment for recovery of liquid tank cargo from a seagoing vessel, in order to stop a leakage, includes a container (3) of fabric which can be packed together for stand-by storing and which can be placed in the sea in order to receive at least some of the tank contents, by pumping the contents through at least one hose (4) which is connected or permanently coupled to the container.

7 Claims, 2 Drawing Sheets

EQUIPMENT FOR RECOVERY OF LIQUID TANK CARGO FROM A VESSEL

BACKGROUND OF THE INVENTION

The present invention relates to equipment for recovery of liquid tank cargo from a vessel at sea, such as a tanker having an oil cargo, in the case of a leakage, for instance by running aground.

It has shown to be nearly impossible to prevent a disaster when oil leaks from a tanker, when the leakage itself cannot be stopped. Recovery of the oil that has leaked out has shown to be little efficient.

The invention is premised upon the inefficient recovery of the leaked oil which has been attempted and the appreciation that the problem can be attacked in a substantially different manner, by limiting the leakage itself substantially.

This is achieved with the equipment according to the invention, which constitutes stand-by equipment to be used as immediately as possible after leakage from a tanker has been discovered, in order to limit as far as possible the quantity of leaking oil.

Oil is usually transported in tankers in such a manner that the oil level in the tanks of the vessel is higher than the water level outside the vessel. Moreover, an excess pressure is usually established by means of an inert gas above the oil, in order to prevent evaporation of oil. Thus, if the formation of a hole occurs in the bottom of the vessel, oil will be forced out because of the excess static pressure of the oil relative to the static pressure of the water surrounding the vessel, and the excess pressure of the gas above the oil will contribute to increase the leakage of oil. If nothing is done to prevent the leakage, except that the excess pressure may come to an end when the volume of the free space above the oil increases due to the leakage, the leakage may continue until a static equilibrium between the remaining oil in the vessel and the surrounding sea water has been established. By the time such an equilibrium occurs very large quantities of oil may have leaked out, and a disaster will usually be a fact, even if attempts of recovering the oil from the sea are made.

The primary purpose of the equipment according to the present invention is to stop the leakage itself, by as quickly as possible to pumping oil out of the vessel or from the tank or tanks of the vessel from which leakage occurs, whereby the oil is collected in a container which is carried along or stored in a collapsed state and which in a case of leakage is placed in the sea, whereupon oil is pumped from the vessel and into the container.

Preferably a low pressure is established in the free space of the vessel above the leaking oil, in order to limit the outflow of oil. The pumping of oil to the container floating in the sea is, however, most important, in order to reduce the oil level inside the vessel so that the static excess pressure of the oil relative to the static pressure of the sea water in the leakage area diminishes and preferably is eliminated or becomes so small that continued leakage can be prevented by the low pressure.

The collapsed container, which may for instance lie on the deck of the vessel, can be permanently coupled to a hose connected to a pump in the vessel. The hose can be wound on a drum, and the collapsed container, which can be made of a fabric, may for instance be stored on some kind of a catapult device, in order to be hurled onto the sea.

A pump for establishing low pressure above the leaking oil may also be permanently connected and ready for use.

The equipment according to the present invention can also constitute a mobile unit which comprises a collapsible fabric container and a hose being wound on a drum and coupled to the container, whereby the container in a collapsed condition is releasably fastened to a stand in which the drum is journalled.

Moreover, the unit may comprise another drum with a hose adapted to be introduced in a leaking tank in a vessel, and the two hoses may be coupled together. A pump may be interposed between the two hoses.

Such a mobile unit (or several) according to the invention can be permanently situated aboard a vessel, but the most important use is assumed to be that several units are placed on land, preferably in coastal areas, in order that they may be carried by helicopters or seagoing vessels to a leaking vessel. After having been brought to the vessel the unit is made ready for use, in that the fabric container is hurled onto the sea, the stand is placed on a deck on the vessel and the hose being coupled to the container is brought in communication with the leaking tank in order to pump oil into the fabric container.

In order to be efficient the fabric container must have a large volumetric capacity, but the capacity will in practice be limited by the total weight of the unit in its stand-by condition, depending on how the unit is to be transported, when it is assumed that it is situated on land. For transportation by helicopter the weight should presumably be limited to about 3 tons, and this is supposed to permit a volumetric capacity of the fabric container of up to about 10.000 $m^3$. For transportation by seagoing vessels the limit is of course substantially higher.

In order to prevent the container, when lying in the sea and receiving oil from a leaking vessel, from drifting away so that the hose for transfer of oil is torn apart, it may be necessary to moor the container to the vessel. The unit may for this purpose also conveniently comprise a third drum carrying a mooring line. In the stand-by condition the container in a collapsed state may simply be fastened to the stand by suitable means, but preferably in such a manner that the container can be released from the stand while the stand is hanging below a helicopter. It may for instance incorporate strap fasteners which can be released from the helicopter. The container may, however, be situated in some kind of a cover, for instance a bag or a box. The bag may for instance have an opening in the bottom which is closed during storage and transportation and which can be opened from the helicopter in order to be dropped onto the sea, for instance by cord release. Correspondingly the box may have a lid which can be opened from the helicopter, or the box may be open along one side or end, for pulling out the container.

The invention will be explained more detailed in the following, by means of diagrammatically shown examples, with reference to the accompanying drawings.

DETAILED DESCRIPTION OF THE PREFERRED EMBODIMENT

Figure 1:
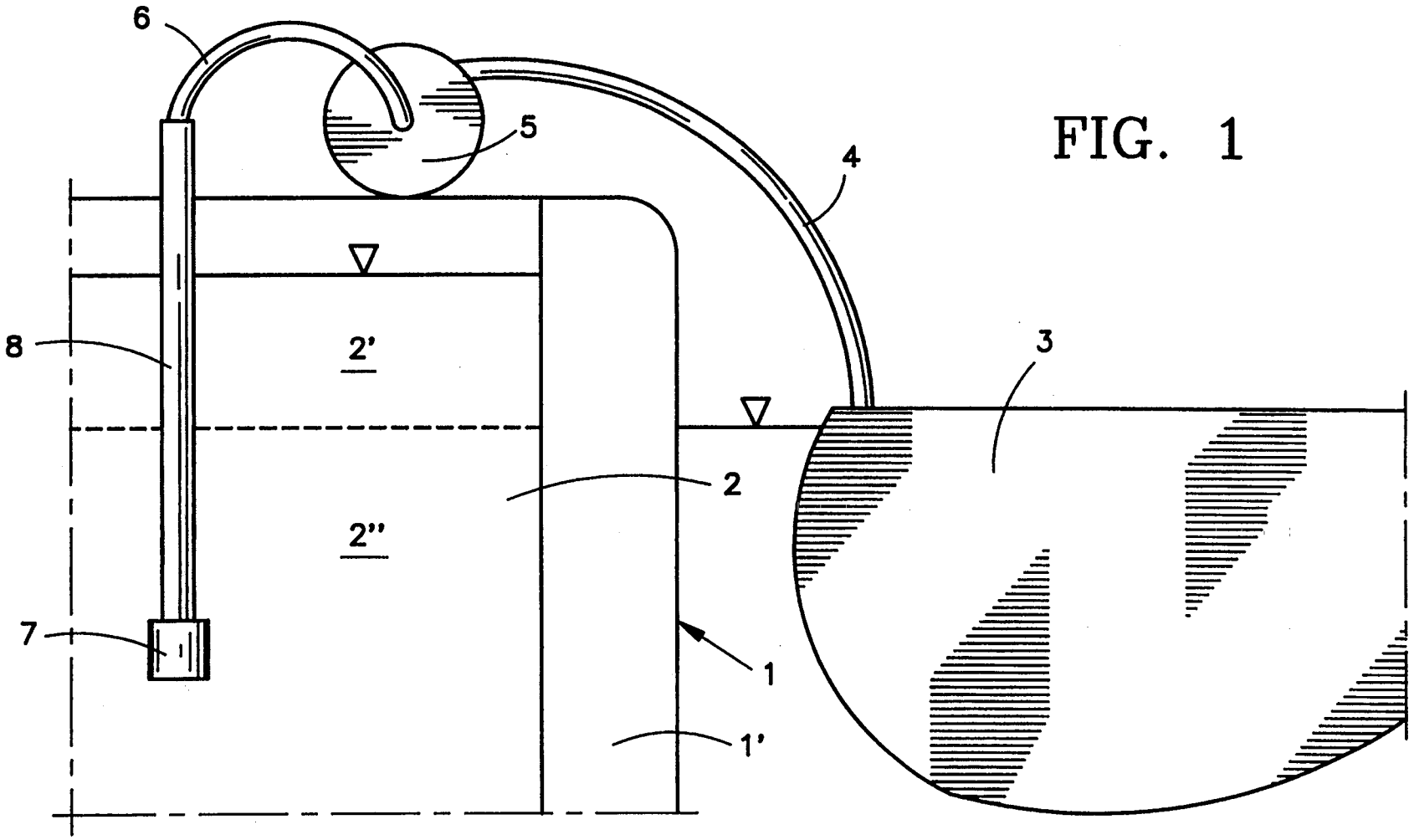
FIG. 1 shows equipment which can be in a permanent stand-by condition aboard a vessel, in order to be taken into use immediately when a leakage occurs.

FIG. 1 shows a vertical section through a portion of a tanker 1, which is presupposed to have a leak in the bottom portion thereof, so that oil in a tank 2 flows out into the sea. The Fig. shows a ballast room 1' at the outer side of the tank 2. The Fig. illustrates the use of the equipment according to the invention, which comprises a flexible container 3 of fabric, situated in the sea near the vessel 1 and connected to the vessel through a hose 4, through which is pumped oil from the tank 2 to the container 3. The vessel is equipped with a pump 7 for the pumping and a vertical tube 8 in the tank 2, and another hose 6 connects the tube 8 to a drum 5, on which the hose 4 has been wound before use.

Prior to being used the container 3 has been stored aboard the vessel, for instance on deck, in a collapsed condition. The container 3 may conveniently be stored on a catapult device, in order to be hurled onto the sea for being used.

In the situation shown the tank 2 contains a quantity of oil 2'' situated below the sea water level outside the vessel 1, and a quantity of oil 2' is situated above the sea water level. Despite the lower density of the oil relative to the sea water, the difference between the levels (before any substantial quantity of oil has leaked out) is usually so large that the static oil pressure at the bottom of the tank 2 is higher than the static sea water pressure at the same level on the outside. The mentioned excess pressure caused by gas above the oil acts in addition to this. In a case of leakage this excess pressure can simply be interrupted, and the equipment according to the invention may comprise (not shown) means for establishing a low pressure above the oil. This implies that it is not necessary to lower the oil level in the tank 2 down to the sea water level outside the vessel in order that the outflow of oil into the sea shall stop. The outflow will stop at a higher oil level than the sea water level. This level difference is determined by the difference of density between the oil and the sea water and by the degree of low pressure. By as rapidly as possible establishing a low pressure and pumping oil out and into the container 3 until the level difference has been achieved a further outflow of oil into the sea can be prevented. It is, consequently, only necessary to pump out a fraction of the oil contents in the tank 2 in order to stop the outflow of oil through a hole in the bottom of the vessel.

For a large tanker a container adapted to contain 30.000 $m^3$ of oil will be sufficient. Such a container, made of fabric, may have a weight of approximately 10 tons, and the necessary auxiliary equipment, for instance a catapult, a drum with hoses and tubes and possibly a suction device for establishing low pressure may have a weight of approximately 5 tons.

The establishing of low pressure above the oil in the tank 2 is of great importance with respect to stopping the outflow of oil rapidly. A partial vacuum of 0,5 atm. (50 kPa) corresponds to a water column of 5 m and a somewhat higher oil column.

A container 3 made of a suitable fabric and having an oil capacity of about 30.000 $m^3$ is able to be packed together to a package of about 6 $m^3$ for being stored aboard a vessel. Instead of storing the container on a catapult it may of course be stored to be hoisted overboard. The container may be permanently coupled to the hose 4 which is wound on the drum 5 and also the hose 6, the tube 8 and the pump 7 may be permanently installed and ready for use.

The container 3 may also be suspended in davits, like a life boat, in order to be lowered to the sea.

Figure 3:
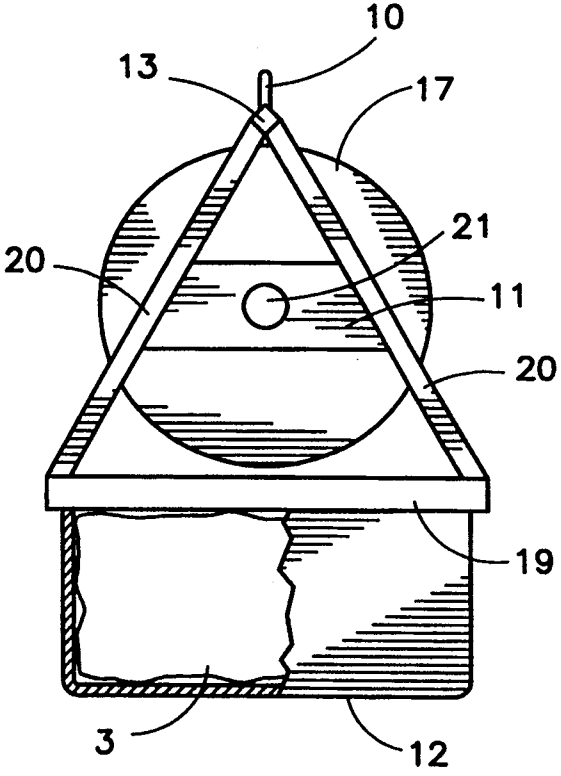
FIG. 3 is an end view of the mobile unit shown in FIG. 2.
Figure 2:
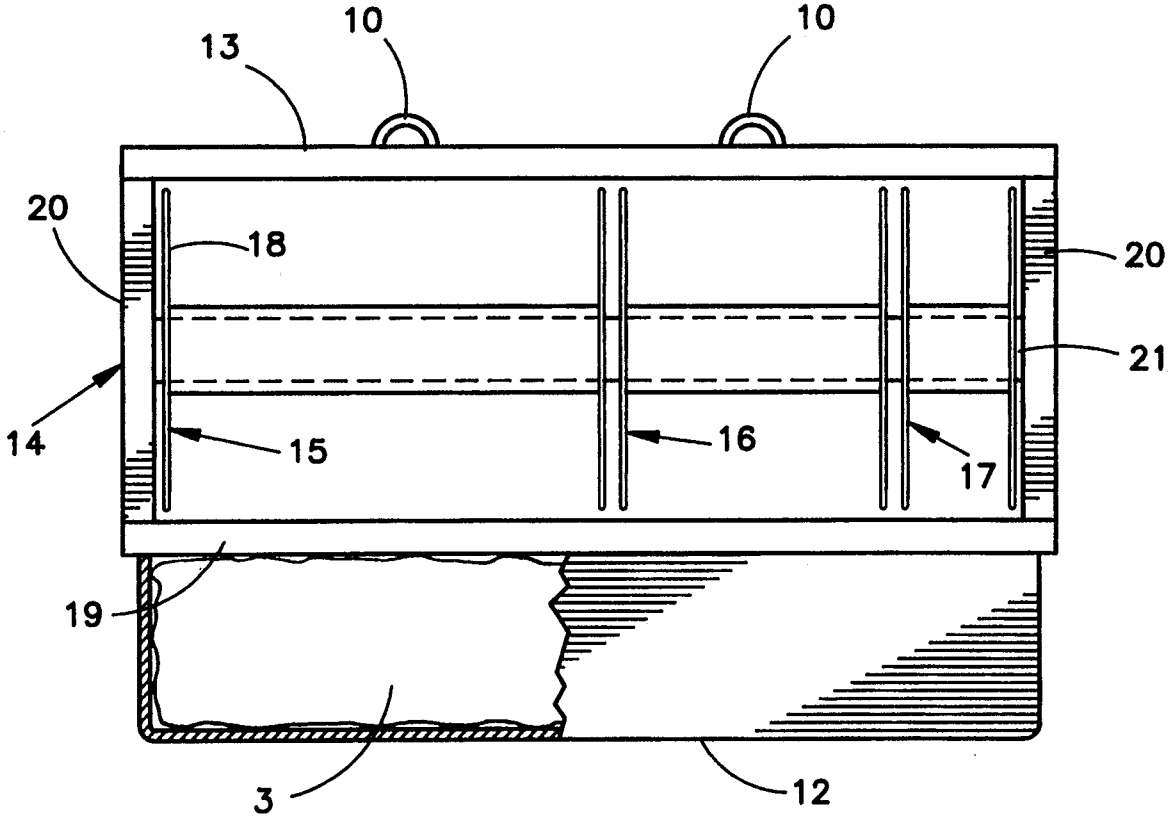
FIG. 2 is a side view of a mobile unit in accordance with the present invention.

FIGS. 2 and 3 show equipment according to the invention, in the form of a mobile unit, and show the unit seen from the side and from one end, respectively.

The shown unit comprises a collapsed fabric container 3', which in the example is situated inside a box 12. The box 12 is fastened below a stand 14, in which are journalled three drums 15, 16, 17. Each drum has two end discs 18 and a hub, which together define the space where a hose or a line is wound. The hoses and the line are not shown. The shown stand 14 is constituted by rods 19, 20, 13. The lower rods 19 constitute a bottom frame, and the rods 20 are inclined upwardly from the rods 19 and are fastened to an upper, horizontal top rod 13. Between the rods 20 at each end of the unit is fastened a slab 11 providing support for a shaft 21 which carries the drums 15 16, 17. At the top of the top rod 13 are fastened loops 10 which can be used for attachment of hoisting means.

A hose, (not shown) which preferably is permanently coupled to the container 3, is wound on the drum 15. Another hose, (not shown) adapted to be put into communication with a leaking tank in a vessel, is wound on the drum 16. A mooring line (not shown) for the fabric container 3 is wound on the drum 17. In the case that the unit comprises two hoses, each of which being wound on its own drum, the hoses may be permanently coupled together. This may for instance be achieved in that the inner ends of each hose are equipped with a pipe bend in communication with the inside of the shaft 21, which is in the form of a tube . This tube is of course closed, so that oil can only flow from the drum 16 to the drum, 15, i.e. without flowing axially out from the tube. A simple solution consists in that the drums 15 and 16 are fastened to the tube 21, so that the drums have to rotate simultaneously and uniformly. To the contrary, in order to achieve that the drums can rotate independently of each other, a two- part tube 21 can be used, having a swivel coupling between the two parts. This is per se a known technique, and will not be described any further.

The two hoses do not necessarily have to be in mutual communication while they are wound on the drums. It is possible to interconnect the inner ends of the hoses after they have been unwound. A separate hose can be used for the interconnection, and a pump can be coupled therein, possibly combined with a motor. The separate hose and the pump can be mounted on the unit. The motor can be an electric motor, a pneumatic motor, a hydraulic motor or an internal combustion engine.

The stand structure shown in the drawing is purely diagrammatic. The shown rods 19, 20, 13 can have any kind of cross sectional shape and be made of any kind of suitable materials. Taking into account a favourable relationship between strength and weight an aluminium alloy may be well suited. The stand needs, moreover, not consist of rods or solely of rods. A structure consisting entirely or partially of plates may also be used. What in the principle is necessary is a stand which constitutes a support for one or more drums.

The hoses being used, as well the mobile equipment, can be of any kind of suitable type, and this also applies to the fabric container. The latter can be made of a laminate which comprises a thin cloth of high tensile strength and a layer on the inside which seals against liquid penetration. Of course, a layer may also be situated on the outside. In order to prevent the fabric container from rupturing as a result of rubbing against a side of a vessel, it may entirely or partly consist of a double cloth and a suitable filler material between the cloth layers. For instance expanded polystyrene can be used as filler material. The fabric container can, however, be given such a shape that it takes a well defined floating position in the sea, and in such a case filler material may be used only in the outermost side portions, in order to limit the volume of the container in its collapsed state.

The equipment according to the invention can of course be used for leakage of any kind of liquid which the container can withstand to contain, and the container can be made of materials which withstand all liquids in question.

It is to be noted that the volumetric capacity of the container does not need to correspond to the total amount of liquid in a leaking tank. It is sufficient to pump out as much liquid from the tank that the static liquid pressure at the leaking spot becomes lower than the static sea water pressure outside. A unit according to the invention, therefore, can be used to stop leakage from a tank containing a liquid volume which is several times as large as the liquid volume with which the container can be filled.

I claim:

1. An apparatus for the recovery of liquid cargo carried by a leaking tank of a seagoing vessel comprising:

a flexible container formed from a layer of fabric, said flexible container being expandable from a collapsed, closely packed storage condition wherein the flexible container can be readily transported to an expanded in-use condition wherein the flexible container is placed in the sea in order to receive at least some liquid cargo from a leaking tank of a seagoing vessel; and means for transferring liquid cargo from the leaking tank to the flexible container, said transferring means including at least one hose and a pump fluidly connected to the at least one hose, said pump being adapted to cause the liquid cargo to flow from the leaking tank to the flexible container through the at least one hose.

2. The apparatus according to claim 1, wherein the at least one hose is coupled to said flexible container.

3. The apparatus according to claim 2, wherein the at least one hose is permanently coupled to the flexible container.

4. The apparatus according to claim 1, further comprising a mobile unit including means for carrying said flexible container in said collapsed storage condition, said mobile unit further including at least one drum adapted to carry said at least one hose.

5. The apparatus according to claim 4, wherein said at least one hose includes first and second hoses and said at least one drum includes first and second drums, said first hose being carried by said first drum and being adapted, in combination with said pump, to draw liquid cargo from the tank, said second hose being carried by said second drum, in fluid communication with said first hose, and being adapted to transfer liquid cargo from the first hose to said flexible container.

6. The apparatus according to claim 5, wherein said mobile unit includes a stand portion rotatably supporting said first and second drums.

7. The apparatus according to claim 6, wherein said mobile unit further includes a box portion fastened below said stand portion, said box portion housing said flexible container when said flexible container is in said collapsed storage condition.

* * * * *